US010085508B2

(12) United States Patent
Surabhi

(10) Patent No.: US 10,085,508 B2
(45) Date of Patent: Oct. 2, 2018

(54) HELMET

(71) Applicant: Kranium Sports, LLC, Oceanside, CA (US)

(72) Inventor: Anirudha Surabhi, London (GB)

(73) Assignee: Kranium Sports, LLC, Oceanside, CA (US)

( * ) Notice: Subject to any disclaimer, the term of this patent is extended or adjusted under 35 U.S.C. 154(b) by 0 days.

(21) Appl. No.: 15/133,000

(22) Filed: Apr. 19, 2016

(65) Prior Publication Data

US 2017/0280810 A1 Oct. 5, 2017

Related U.S. Application Data

(63) Continuation of application No. 13/700,045, filed as application No. PCT/GB2011/000814 on May 26, 2011, now abandoned.

(30) Foreign Application Priority Data

May 26, 2010 (EP) ..... 10250978

(51) Int. Cl.

| | |
|---|---|
| ***A42B 3/06*** | (2006.01) |
| ***A42B 3/32*** | (2006.01) |
| ***A42B 3/12*** | (2006.01) |

(52) U.S. Cl.

CPC ..... *A42B 3/065* (2013.01); *A42B 3/06* (2013.01); *A42B 3/063* (2013.01); *A42B 3/067* (2013.01); *A42B 3/124* (2013.01); *A42B 3/322* (2013.01)

(58) Field of Classification Search

CPC .. A42B 3/00; A42B 3/06; A42B 3/063; A42B 3/065; A42B 3/067; A42B 3/068; A42B 3/069; A42B 3/124; A42B 3/322; A63B 71/10; F16F 7/121; F16F 7/122

USPC ..... 2/410–412, 414

See application file for complete search history.

(56) References Cited

U.S. PATENT DOCUMENTS

| | | | |
|---|---|---|---|
| 2,765,472 | A | 10/1956 | Schoen |
| 2,870,694 | A | 1/1959 | Colvin |
| 3,353,188 | A | 11/1967 | Laddie |
| 3,514,787 | A | 6/1970 | Kennedy, Jr. |
| 3,877,076 | A | 4/1975 | Summers et al. |

(Continued)

FOREIGN PATENT DOCUMENTS

| | | | |
|---|---|---|---|
| FR | 2335168 A1 * | 7/1977 | ..... A42B 3/124 |
| FR | 2 561 877 A3 | 10/1985 | |

(Continued)

OTHER PUBLICATIONS

English machine translation of "FR 2335268 A1" via Espacenet. URL:<http://worldwide.espacenet.com/?locale=en_EP> (translation generated on May 27, 2015).*

(Continued)

*Primary Examiner* — Jameson Collier

(74) *Attorney, Agent, or Firm* — Procopio, Cory, Hargreaves & Savitch LLP

(57) ABSTRACT

A head protection helmet including an impact resistant shell that includes a cavity for accommodating a user's head. The helmet further includes an array of crushable bodies having a hollow closed configuration, e.g. flutes in corrugated material 14, 16, the crushable bodies each having an axis that extends outwardly from the cavity to absorb impact forces exerted along the direction of the axis.

6 Claims, 8 Drawing Sheets

(56) References Cited

U.S. PATENT DOCUMENTS

| | | | |
|---|---|---|---|
| 3,987,495 | A | 10/1976 | Holley |
| 3,991,422 | A | 11/1976 | Saotome |
| 4,091,470 | A | 5/1978 | Ryunoshin |
| 4,291,417 | A | 9/1981 | Pagano |
| 4,587,676 | A | 5/1986 | Estadella |
| 4,607,397 | A | 8/1986 | Laxo |
| 4,827,537 | A | 5/1989 | Villa |
| 4,905,320 | A | 3/1990 | Squyers |
| 5,012,533 | A | 5/1991 | Raffler |
| 5,139,838 | A | 8/1992 | Baum |
| 5,204,998 | A | 4/1993 | Liu |
| 5,319,808 | A | 6/1994 | Bishop et al. |
| RE35,193 | E | 4/1996 | Shifrin |
| 5,515,546 | A | 5/1996 | Shifrin |
| 5,544,367 | A | 8/1996 | March et al. |
| 5,561,866 | A | 10/1996 | Ross |
| 5,604,935 | A | 2/1997 | Nezer |
| 5,628,071 | A | 5/1997 | Nezer et al. |
| 5,661,854 | A | 9/1997 | March et al. |
| 5,734,994 | A | 4/1998 | Rogers |
| 5,747,140 | A | 5/1998 | Heerklotz |
| 5,896,590 | A | 4/1999 | Fleisch |
| 5,950,243 | A | 9/1999 | Winters |
| 6,159,324 | A | 12/2000 | Watters et al. |
| 6,301,718 | B1 | 10/2001 | Rigal |
| 6,314,586 | B1 | 11/2001 | Duguid |
| 6,442,765 | B1 | 9/2002 | Fallon et al. |
| 6,532,602 | B2 | 3/2003 | Watters et al. |
| D472,582 | S | 4/2003 | Miska |
| D472,934 | S | 4/2003 | Miska |
| D473,265 | S | 4/2003 | Miska |
| D480,761 | S | 10/2003 | Miska |
| 6,637,037 | B1 | 10/2003 | Hung |
| 6,941,582 | B2 | 9/2005 | Miska |
| 7,328,462 | B1 | 2/2008 | Straus |
| 7,958,572 | B2 | 6/2011 | Loury et al. |
| 8,317,933 | B2 | 11/2012 | Bilias |
| 2002/0106483 | A1 | 8/2002 | Obeshaw |
| 2002/0185795 | A1 | 12/2002 | Le |
| 2005/0200062 | A1 | 9/2005 | Maurer et al. |
| 2005/0246824 | A1 | 11/2005 | Berger et al. |
| 2005/0281987 | A1 | 12/2005 | Starke |
| 2006/0075693 | A1 | 4/2006 | Tsunoda et al. |
| 2007/0056081 | A1 | 3/2007 | Aspray |
| 2007/0083965 | A1 | 4/2007 | Darnell et al. |
| 2007/0089480 | A1 | 4/2007 | Beck |
| 2007/0226881 | A1 | 10/2007 | Reinhard |
| 2009/0307827 | A1 | 12/2009 | Aspray |
| 2010/0031426 | A1 | 2/2010 | Lapham |
| 2012/0216338 | A1 | 8/2012 | Arrouart |

FOREIGN PATENT DOCUMENTS

| | | | |
|---|---|---|---|
| GB | 717 121 | A | 10/1954 |
| GB | 1578351 | A | 11/1980 |
| JP | 2006077934 | A | 3/2006 |
| WO | 2012049463 | A1 | 4/2012 |

OTHER PUBLICATIONS

Weekthirteen. "inspired by nature: collapsible bike helmet." Retrieved from http://weekthirteen.blogspot.com/2010/11/inspired-by-nature-collapsible-bike.html on Sep. 2, 2014. Posted on Nov. 6, 2010. 4 pages.

European Search Report dated Apr. 12, 2013 in related EP Patent Application No. 11724002.8, in 14 pages.

International Search Report and Written Opinion for PCT/GB2011/000814, dated Jan. 2, 2012.

International Preliminary Report on Patentability for PCT/GB2011/000814, dated Nov. 27, 2012.

* cited by examiner $$Q_x > Q_y$$

or $$Q_x = Q_y$$

HELMET

TECHNICAL FIELD

The present invention relates to a helmet. The helmet is primarily intended as a cycling helmet to provide head protection in the event of a cycling accident. However, it also finds application at any time when head protection is needed, for example ice skating, roller skating, skateboarding, caving, climbing, e.g. indoor climbing or mountain climbing, skiing, baseball, American football, ice hockey and head protection at work or when working at heights, e.g. in the construction industry.

TECHNICAL BACKGROUND

Most bicycle helmets available have (a) a thin outer layer, which may be made, for example, out of polypropylene that is able to absorb initial peak impact forces, (b) a shell within the thin layer and composed of expanded polystyrene that absorbs both initial and subsequent impact forces and (c) padding within the expanded polystyrene shell both to provide comfort to the user and to adjust the shape of the internal cavity within the shell for different shaped and sized heads.

In general, a cycling helmet should fit closely over the cyclist's head so that any impact force is spread over as wide an area of the head as possible. The impact forces are absorbed by the thin polypropylene layer and the expanded polystyrene shell. In addition, some helmets fracture under impact, which also absorbs energy and reduces the energy transferred to the head.

Cycling helmets are often treated roughly and such rough treatment can impair the effectiveness of the helmet. However, there is often no outward visible sign of such impairment.

As mentioned, cycling helmets and helmets for other uses are generally made of synthetic plastics. Although it would be desirable to make the helmets at least partly out of natural material that could be recycled, it is counter-intuitive to use such materials in applications requiring the resistance of such strong forces.

Helmets should generally be light to be acceptable to wearers. Sports protective helmets should also be well ventilated so that sweat does not accumulate around the user's head and so that body heat generated due to the exertion of cycling or other sport can be displaced through the head.

Although the materials used for making the cycling helmets are not particularly expensive, it would advantageous to use cheaper materials, if possible.

DISCLOSURE OF THE INVENTION

The present invention uses the strength of flutes or hollow tubes, e.g. hollow cylinders, hollow cells and hollow frustocones, in a helmet to resist impact and also to crumple on impact, such crumpling absorbing significant energy which is thereby not transferred to the user's head.

In one embodiment, the flutes may be those present in corrugated material, e.g. corrugated fibre board can be used to absorb impact energy. In this case, an impact resistant shell of the helmet of the present invention can be made of such corrugated material, which may be in the form of intersecting arc shaped ribs overlying a head cavity of the helmet and extending outwards, optionally radially outwards, from the cavity. In this case, the arc-shaped ribs may be arranged to extend generally axially (front to back) and laterally (side to side). The arrangement of the flutes may be such that at the front, top and sides of the helmet, at least some of the flutes extend radially outwards from the cavity (e.g. forwardly and optionally also upwardly at the front and sideways and optionally also upwardly at the respective sides). The positioning of the flutes can be brought about by suitably locating the arc-shaped ribs and by selecting the direction of the flutes within those ribs.

However, sufficient impact resistance can be achieved using the above intersecting arc-shaped ribs but without the use of flutes. The arc-shaped ribs may each be made of one or more sheets. When two or more such sheets are present in a single rib, they will generally lie parallel to each other and may be joined together in a spaced apart relationship. When each rib has three or more sheets, each spaced may be apart from, and connected to, its neighbouring sheet. The material joining the sheets together and maintaining the sheets in a parallel spaced-apart configuration may be composed of cells. Such cells may be formed by a corrugated sheet, as discussed above, or by cells having walls and or axes that extend generally orthogonal to the planes of the sheets. For example, the sheets may be connected by an array of honeycomb cells where the individual cells are hexagonal, square or rectangle in cross-section. The honeycomb cells, which are connected to the sheets overlying them, increase the resistance to flexing of the ribs and thereby make them stiffer. They also maintain the sheets in a parallel spaced-apart configuration, which means that the sheets themselves can absorb greater impact forces than if the sheets were connected together by flutes that have lower ability to maintain the sheets in parallel.

The sheets are preferably semi-rigid, where the term "semi-rigid" material is used in the present specification in relation to a sheet to denote a material that will remain in a planar configuration but can be crumpled by a substantial force applied within the plane of the sheet. The force it can withstand before crumpling will depend on the nature of the ribs, and the arrangement of the sheets within each rib and the number and arrangement of the ribs within a helmet. The semi-rigid material should be such that the helmet overall can withstand the force required for the application concerned and the various standard that apply to these helmets. Typical materials include cardboard and stiff but flexible plastics.

The arc-shaped ribs may together form an intersecting array or lattice, with ribs extending axially between the front and the back of the head cavity and laterally between the two opposed sides of the head cavity; they can also extend diagonally. Naturally, the ribs will intersect in such an arrangement and, at the intersection point, the ribs preferably form crossed halved joints, which are made by forming a groove in the lower part of one rib and another groove in the upper part of the other rib so that the two ribs can be slotted into each other without severing either rib completely. The joint can be an interference fit between the two ribs or adhesive can be used to cement the two ribs at the joint. Alternatively, some of the grooves in the ribs may be larger than is necessary to accommodate the intersecting ribs, partly to make manufacture easier and partly to allow a limited amount of movement or play between the ribs, which helps absorb energy in a crash.

As mentioned above, when corrugations are provided, the corrugations provide the impact strength along the direction of the flutes. Therefore, at the centre of each arc-shaped rib, it is preferred that the flutes extend either parallel to the edge of the rib or at right angles to the edge of the ribs. The latter arrangement absorbs impact forces exerted on the centre of the rib at a right angle to the edge. The former arrangement provides strength at the ends of the rib rather than in the centre and can absorb impact forces exerted at right angles of the ends of the ribs. The flutes in adjacent ribs need not be parallel to each other and indeed it may be advantageous if that is not the case so that adjacent ribs can absorb impact forces applied from different directions. Thus, for example, the flutes of one arc-shaped rib can extend at right angles to the flutes on the adjacent rib.

The helmet may include a rim encircling the head cavity that may also be made of the same material as the ribs; if made of corrugated material containing flutes, the flutes preferably extend from the front to the back of the head cavity so as to absorb front impact forces.

Although the corrugated material may be made of plastic, it is preferred to use fibre board (e.g. corrugated cardboard) since the materials for making fibre board are natural and the helmet can be recycled after use. Corrugated fibreboard can be obtained commercially in a large number of different qualities but all qualities are relatively cheap. Honeycombed fibreboard can be made by forming a layer of honeycomb cells and adhering to this layer to the face sheets.

In a second embodiment, instead of flutes in corrugated boards, the strength of the impact resisting shell may be provided by an array of hollow tubes, e.g. cylinders or frusto-cones, typically made from sheet material, especially paper and cardboard. The ends of the cones or cylinders should point outwardly from the head cavity so that they are able to absorb impact and also crumple under that impact, thereby absorbing energy and reducing the force that is transmitted to the user's head in the event of an accident.

Cylinders, when packed together in a dome-shaped array, may not present a smooth external surface or a smooth inner surface that outlines the head cavity. In order to address this, it is possible to machine the external or internal surfaces to provide such a smooth domed shape. However, it is not necessary to produce a smooth dome shape to the outside surface.

Furthermore, an uneven dome shape within the cavity of the impact resistant shell can be tolerated if an inner shell is provided that has a matching outer surface; the inner shell may then provide a smooth domed inner surface. The role of the inner shell will be discussed below. A domed shape can be achieved more easily by using hollow frusto-cones instead of cylinders with the larger end face of the cones pointing outwardly while the smaller faces point inwardly.

The tubes (hollow frusto-cones or cylinders) can be held in a bundle or array with each tube being in contact with a neighbouring tube. A mixture of cones and cylinders can be used. Alternatively, the tubes can be held in position by a matrix material in which they are captured within the matrix material.

Hollow cylinders can be made by winding strips of flexible sheet material into a closed shape and retaining the closed shape, for example, by adhesive. The strips used to form such tubes will generally extend helically around the axis of the tube. The manufacture of hollow cylinders is widely practiced in the manufacture of the cores of paper rolls. Frusto-conical shapes can also be made by a similar winding technique.

The greater the number of tubes (cylinders or frusto-cones) used to make up the impact resistant shell, the greater is the impact strength of the shell. Therefore, the outside diameter of the cylinders or frusto-cones will generally not exceed 4 cm and, for example, will generally not exceed 3 cm. On the other hand, a greater number of tubes will increase the complexity of manufacturing the shell and accordingly the outside diameter of the cylinder should preferably be at least 0.5 cm, e.g. 1 cm. In the case of frusto-cones, the mean diameter of the cones should generally lie in the above ranges.

The tubes (cylinders or frusto-cones) should crumple on impact. In order to control the degree of crumpling, a line of weakness may be provided in the walls of the hollow tubes along which they can collapse. The lines of weakness are preferably helical in shape so that the crumpling will occur within the boundary of the tubes and the lines of weakness may be provided in the form of holes or openings spaced along the line of weakness.

As is the case in the first embodiment, cheap material used to make the tubes, which material may be plastic but preferably is paper or cardboard. Cork could also be used.

In fact, the distinction between the first embodiments and the second embodiment is not clear-cut since the above-described arrangement of intersecting ribs can also be seen as falling within the scope of the second embodiment since the intersecting ribs form an array of cells that are tubes having a 4-sided cross-section.

In order to waterproof the helmet of the present invention, at least the outside edge regions of the crushable bodies may be covered with a waterproofing material, although optionally an outer shell may be provided that will provide such waterproofing, in which case it is preferred that ventilation openings are provided in the outer shell. The waterproofing material/outer shell is preferably made of a material having a stiffness coefficient higher than that of the material used for forming the crushable bodies so that it is less elastic. In this way, it can assist in resisting the peak force exerted on impact. The preferred materials are polypropylene, acrylic or ABS.

The helmet may include an inner shell, which may perform a number of functions. Firstly, it can add extra impact resistance to the impact resistant shell of the present invention, for example it could be made of moulded expanded polystyrene. Secondly, it can be used to tailor the helmets to the size of a particular user's head. This can be achieved by making the cavity within the impact resistant shell of the present invention in one standard size and providing an inner shell with an outside that matches the size of the impact resistant shell cavity and an inside that has a head cavity that is matched to the size of a user's head; thus a number of inner shells could be manufactured having variously sized internal cavities to fit various head sizes and shapes. Padding may also be provided for additional comfort and/or ensuring that a tight or snug fit is maintained between the user's head and the helmet, e.g. using insertable padding that can be adhered to the inside surface of the inner shell cavity, as is widely practiced with cycling helmets currently available.

A further use of the inner shell is to dissipate the impact forces that are transmitted to the inner ends of the crushable bodies, i.e. the ends lying in the head cavity, so they are not transmitted directly on the user's head. In addition, the shape of the cavity within the impact resistant shell may not be uniformly smooth and the outer surface of the inner shell can, as discussed above, be shaped to match the uneven surface of the cavity in the impact resistant shell. This avoids having to shape the head cavity of the impact resistant shell in an expensive manner. The inner shell may be permanently attached to the impact resistant shell of the present invention or may be releasable attached, e.g. using loop-and-hook fastenings, e.g. VELCRO® , so that the impact resistant shell of the present invention is replaceable if dented.

Instead of a continuous inner shell, a series of pads may be used that lie between the array of crushable bodies and the user's head. Such pads may be made of relatively rigid foam material to provide a cushion between the crushable bodies and the user's head. The series of pads may be viewed as a discontinuous inner shell.

Generally, because the outside surface of the impact resistant shell (even with the waterproofing layer or outer shell), is made up of an array of crushable bodies rather than a uniform smooth surface, it will be more evident when the impact resistant shell has been damaged and therefore needs replacing.

The impact resistant shell can be recycled, if made of fibre based materials, such as paper or cardboard. The strength of the crushable bodies will depend on the nature and thickness of the sheet material used and so it is possible to adjust the impact strength and crumpling properties of the helmet by the choice of the sheet material used. in the present specification, the term "outer" shell does not necessarily mean that it forms the outermost layer of the helmet (although it can) and likewise the term "inner" shell does not necessarily mean that it forms the innermost layer of the helmet (although again it can). However, the outer shell will always lie outside the impact resistant shell and any inner shell in the helmet will always lie inside the impact resistant shell.

According to a further aspect of the present invention, there is provided a head protecting helmet comprising a shock indicator that gives it an indication when the helmet has been subject to a shock in excess of a threshold value, thereby indicating that the helmet or at least the shock absorbing part of the helmet should be replaced. Often, for convenience, the magnitude of a shock, which is a force exerted as a result of acceleration or deceleration, is stated as a multiple of the acceleration caused by earth's gravity, which is indicated by the symbol "G". During a bicycle accident, the helmet can suffer shocks of 150 G and after any shock of 150 G should preferably be replaced.

The accelerometer contains at least five tubes or flasks each containing a viscous coloured liquid held in a chamber of the flask by a wall having a capillary bore extending through it that normally retains the liquid within the chamber as a result of the surface tension of the liquid and the small size of the bore. However, if a sufficient force is exerted on the liquid due to shocks, the liquid passes through the capillary into a further chamber; the presence of the coloured liquid in the further chamber indicates that the accelerometer has suffered a shock in excess of a threshold value. The at least five tubes or flasks communicate with a common further chamber and so the present of the coloured liquid in the common further chamber indicates that the helmet needs replacing. Tubes or flasks of the above type are already known and sold under the trademark "SHOCKWATCH®" . The viscosity of the liquid and the size of the capillary bore are preferably designed to allow the liquid to pass into the common chamber when subjected to a threshold shock that is selected from the range of 75-100 G.

We have found that at least five such tubes or flasks are needed to ensure that shock exerted in any direction on the helmet is captured and triggers the release of liquid into the common chamber and the use of a larger number is preferred, e.g. six, eight or more.

The common chamber may be located behind a magnified lens, which could be clear or diffusing, thereby making it easier to detect the triggering of accelerometer.

BRIEF DESCRIPTION OF DRAWINGS

There will now be described, by way of example only, several embodiments of the present invention by reference to the accompanying drawings in which.

DETAILED DESCRIPTION

The helmet of the present invention includes an impact resistant shell that is able to absorb some of the forces exerted on a helmet during a collision with another object, which may be the road, a pavement, a pedestrian or another vehicle. As mentioned above, the present invention is not limited to a cycling helmet but cycling will be used to exemplify the diverse applications for which the helmet may be used, some of which are set out above.

Figure 1:
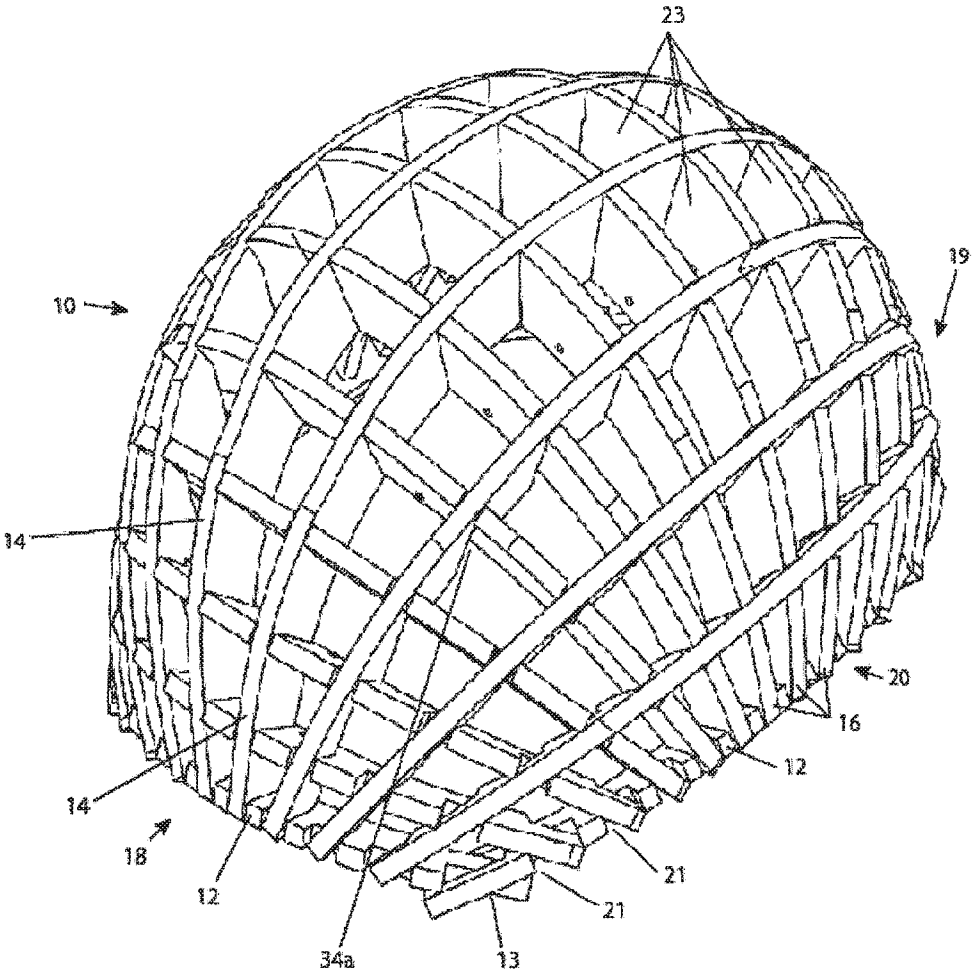
FIG. 1 shows part of a helmet, that is to say an impact resistant shell in accordance with the present invention, viewed from the front and one side.
Figure 2:
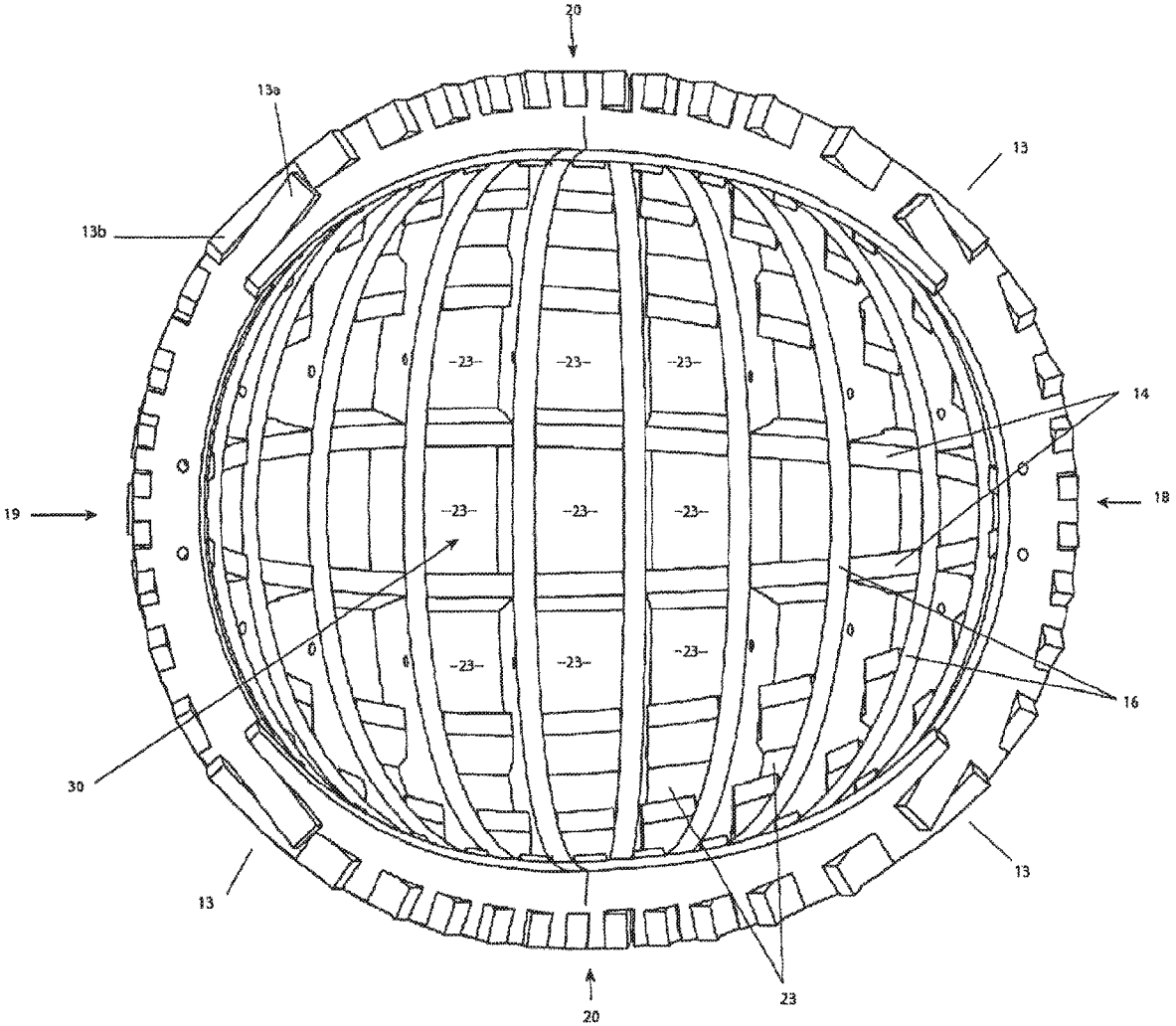
FIG. 2 shows the helmet of FIG. 1 viewed from below.

Referring initially to FIGS. 1 and 2, which show the shell from one side and from below, respectively, the impact resistant shell 10 of the helmet includes a rim 12 made of a solid fibre board. The rim may be made in a single piece or in multiple pieces (as shown in FIGS. 1 and 2) that are joined together at connection 13, which is most clearly shown in FIG. 2. The joint 13 is a simple tongue-and-groove joint that includes a tongue 13*a* on one piece of the rim that slots into a groove 13*b* cut into the end of a second piece of the rim.

The rest of the impact resistant shell 10 is made up (a) of series of axial ribs 14 extending between the front 18 and the back 19 of the helmet and (b) a series of lateral ribs 16 extending between the two sides 20 of the helmet. As can be seen, the ribs are arranged in planes that extend radially outwards from the helmet and form an intersecting lattice of shock absorbing ribs; the lattice can be seen as an array of 4-sided shock-absorbing cells 23. The axial ribs 1 of FIGS. 1 and 2 come together at the front 18 and the rear 1 of the helmet. Likewise, the lateral ribs 16 come together at the two sides 20 of the helmet. The ends of the ribs 14, 16 slot into grooves 21 in the rim 12. They may be held in the grooves 21 by adhesive.

Figure 5:
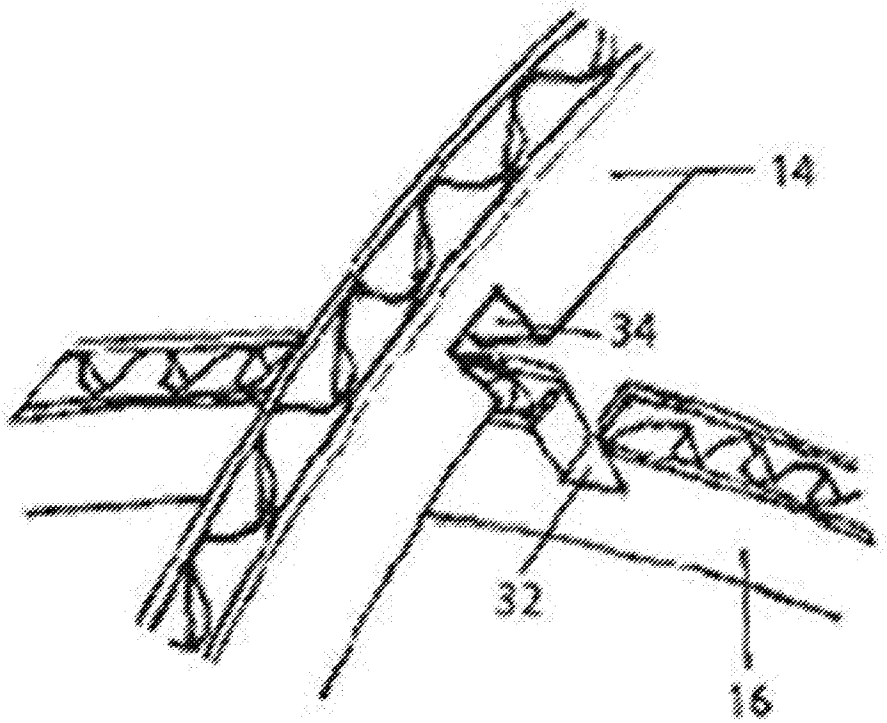
FIG. 5 shows the joint between two arc-shaped ribs used in the helmet of FIGS. 1 and 2.

The ribs 14,16 are arc shaped and the insides of the ribs forms a head cavity 30. As is clear from FIGS. 1 and 2, the ribs 14, 16 intersect with each other. The joints at these intersecting points are shown in an exploded view in FIG. 5. The axial ribs 14 have a groove 34 cut in the concave side of the rib while the lateral ribs 14 have a groove 32 cut in their convex faces. The grooves 32, 34 can then be slotted into each other together to form a halved cross joint, which means that neither of the ribs 14, 16 is cut completely through in order to provide the intersection. The grooves in the ribs 14,16 can extend radially from the centre of the cavity 30. In FIG. 5, the grooves 32,34 are shown to extend at right angles to the plane of the respective ribs but, as can be seen in FIG. 1, the groove may extend in a non-orthogonal direction to the plane of the ribs that forming an intersection. The sizes of the grooves 32, 34 should accommodate the other rib and the ribs may be held in place either by friction or by adhesive or by a mechanical element. As can be seen in FIG. 1, some of the grooves 34 in the ribs 14 (as indicated by the reference number 34*a* in FIG. 1) are larger than necessary to accommodate the corresponding lateral ribs 16 and this provides some play between the ribs which can therefore absorb more impact energy in the case of an accident. Furthermore, it assists in assembling the shell 10.

Figure 3:
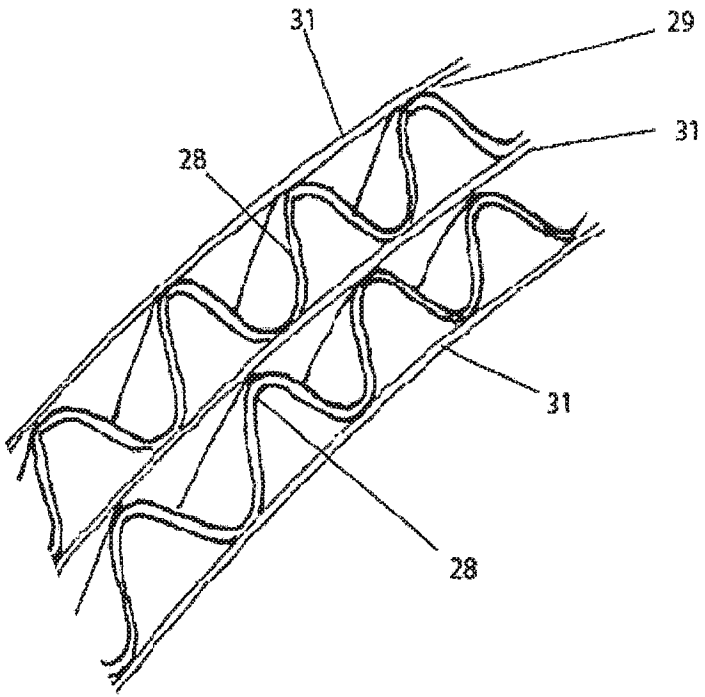
FIG. 3 is an end view of corrugated fibre board that may be used in the helmet of FIGS. 1 and 2.

The ribs 14, 16 may be made of corrugated fibre board, as shown in FIG. 3. Corrugated fibreboard includes at least one undulating section 28 sandwiched between flat fibre board layers 31 to form a series of flutes 29. It possible to build up a number of such layers in a unitary corrugated fibre board (FIG. 3 includes two such undulating sections). The thickness of the material forming the undulations 28 and the thickness of the flat board 1 should be chosen to give the degree of shock resistance and crumpling need to absorb the type of forces exerted during a collision.

Figure 4:
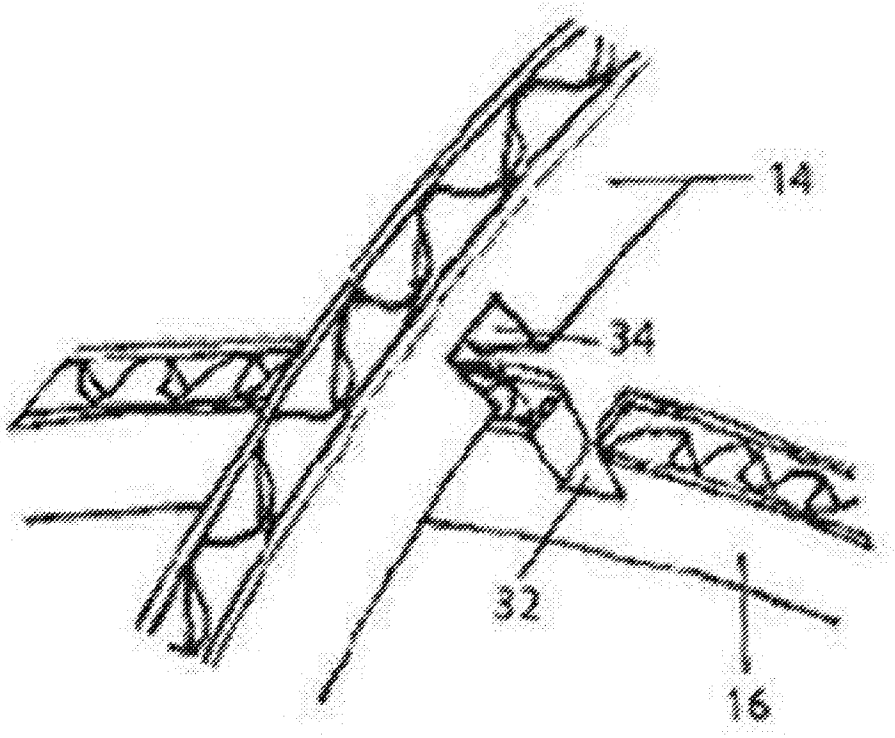
FIG. 4 is a partly cutaway view of part of an arc-shaped rib made of fibre board having a honeycomb core that may be used in the helmet of FIGS. 1 and 2.

Alternatively, the ribs can be made from honeycomb fibreboard, which is shown in FIG. 4 and has a pair of fibreboard face sheets 31; only one face sheets is shown in FIG. 4 and that face sheet is shown partly cut away so that the internal honeycomb array 33 is visible. The honeycomb connects together the face sheets 31 and may be made of plastic or paper or cardboard. It is glued to the face sheets 31 in a known manner. Again, it possible to build up a number of sheets and honeycomb layers in a unitary corrugated fibre board so that three or more sheets 31 are included in each rib, each adjacent pair of sheets sandwiching between them a honeycomb layer.

Turning back to FIGS. 1 and 2 and dealing with the case in which the ribs are made of corrugated fibreboard, the flutes 29 in the ribs may extend in horizontal, vertical, axial or lateral directions or diagonally within the helmet. The flutes in alternate lateral ribs 1 extend horizontally (i.e. in the direction between the two sides of the helmet) and such flutes resist especially lateral forces on the helmet. The flutes in the other lateral ribs 16 extend vertically and such flutes resist vertically acting forces. Likewise in some of the axial ribs 14, the flutes extend horizontally which are resistant to forces impacting on the front or rear of the helmet while the flutes on the other ribs extend vertically and such flutes resist vertically acting forces. Generally, alternate ribs should have vertically-extending flutes and the remaining ribs should have horizontally-extending flutes, although the two central axial ribs 14 may have vertically extending ribs to resist forces exerted down onto the crown of the helmet.

When the ribs are made of the honeycomb material shown in FIG. 4, the honeycomb cells will extend at right angles to the plane of the ribs.

The impact resistant shell shown in FIGS. 1 and 2 can absorb impact forces from any direction and can crumple as a result, thereby absorbing the energy of the impact and protecting the user's head.

In order to provide waterproofing to the fibre board, an outer shell or layer 50 (see FIG. 6) can overlay the shell 10 shown in FIGS. 1 and 2 and which can be fastened to the shell 10, either permanently or temporary. The outer shell 50 should be provided with ventilation holes (not shown) that preferably line up with the spaces between the ribs 14, 16 of the shell 10. In addition, the cardboard used to make the shell 10 may be waterproof by the application of a waterproofing or water resistance layer (not shown).

The outer shell 50 may be made of acrylic material but it could also be made of other materials for example, polypropylene or ABS having a stiffness coefficient higher than that of the material used to make the impact resistant shell 10 and so absorbs part of the initial shock waves when an impact occurs. Slots 52 may he provided in the outer shell in order to attach straps (not shown) that can be secured under the user's chin to hold the helmet on the user's head An inner shell 55 may be provided between the user's head and the cavity 30 within the impact resistant shell 10 in order to provide comfort to the user, to dissipate forces being transmitted through the edges of the ribs 14, 16 directly to the user's head and to ensure that the helmet fits snugly. The inner shell may be made of padding, for example a layer of foam and or woven or non-woven fabric.

Figure 7:
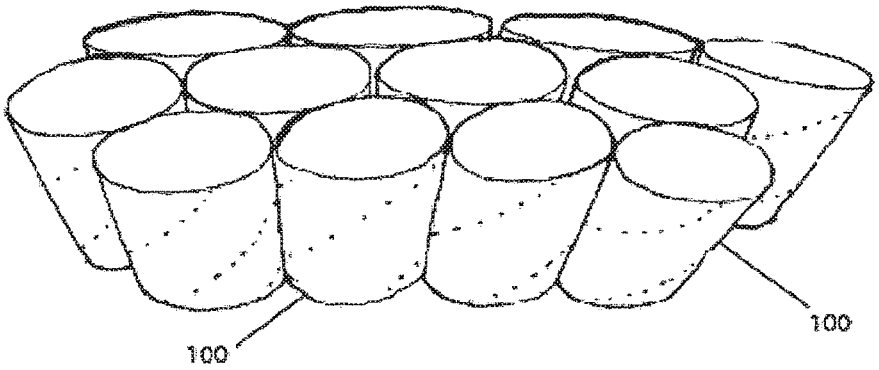
FIGS. 7 and 8 show, schematically, an alternative arrangement to the impact resistant shell of FIGS. 1 and 2.

As is evident from the discussion above, the impact resistant shell 10 shown in FIGS. 1 and 2, when made with the ribs of corrugated fibreboard, provides strength and impact resistance by means of the flutes within corrugated material. In addition impact strength is provided by holding the ribs in a fixed array of 4-sided cells 23, each cell having an axis that extends away from the inner cavity 30 of the helmet and generally radially outward from the cavity. In the case of the ribs being made of the honeycomb material shown in FIG. 4, the strength of the helmet will mostly be provided by this array of 4-sided cells, with the honeycomb pattern within the ribs resisting the collapse of the ribs and thereby maintaining the face sheets 31 in a space-apart parallel configuration, which increases the impact resistance of the individual ribs. In a variant of the cellular structure just described, the shell 10 may be made of an array of cylindrical tubes (see FIGS. 7 and 8) that are arranged in a dome shape and the under surface (not shown) forms a head cavity. The tubes 100 are collected in array with the inner ends of the tubes lying at different elevations in order to provide the shell with a hollow dome-shape. The axis of the various tubes shown in FIG. 9 all extend vertically and are intended to resist vertical forces. However, they can be embedded in a matrix so that they extend in different directions from the head in order to provide protection against forces from different directions.

The tubes, instead of being cylindrical, may be frustoconical, which has the advantage that, when the tubes are gathered together with the larger faces φx (see FIG. 8) pointing outwardly and the smaller faces φy pointing inwardly, the axes of the frusto cones point in different radial directions.

Figure 8:
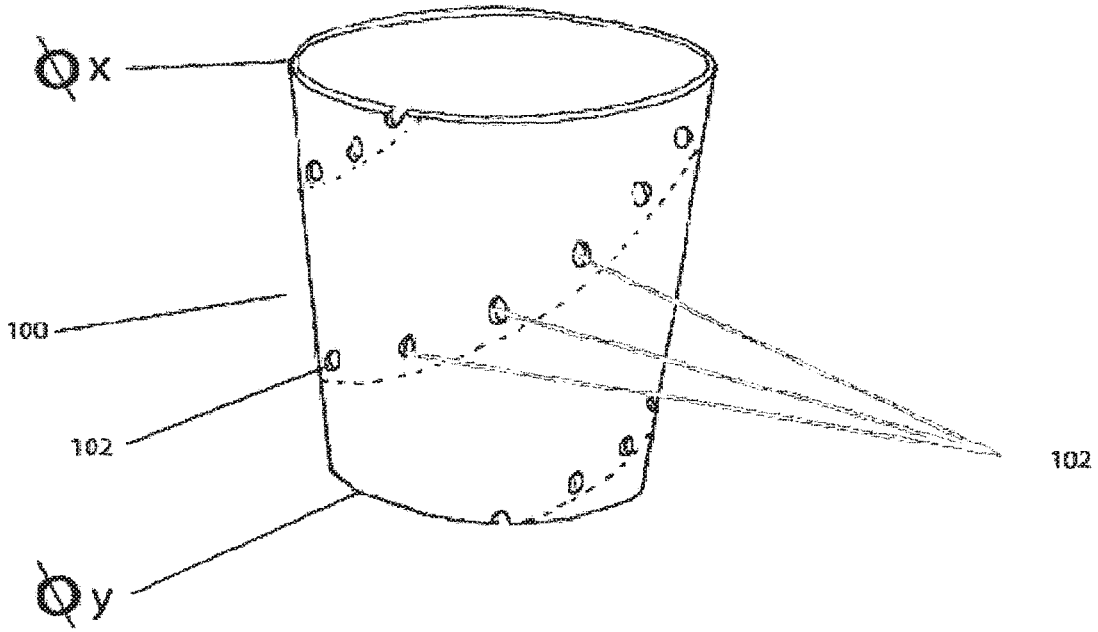

The tubes 100 are hollow and are generally made of fibre board such as paper or cardboard. Tubes made of this configuration can be incredibly strong and can transmit an impact force directly to the user's head without absorbing it. In order to provide some measure of impact absorption, a crumple zone may be introduced in the side walls of the tubes. So that the tubes crumple within their own diameter, it is preferred that the crumple zone is helical in shape and may be formed, as can be seen in FIG. 8, by helically arranged holes 102.

Figure 6:
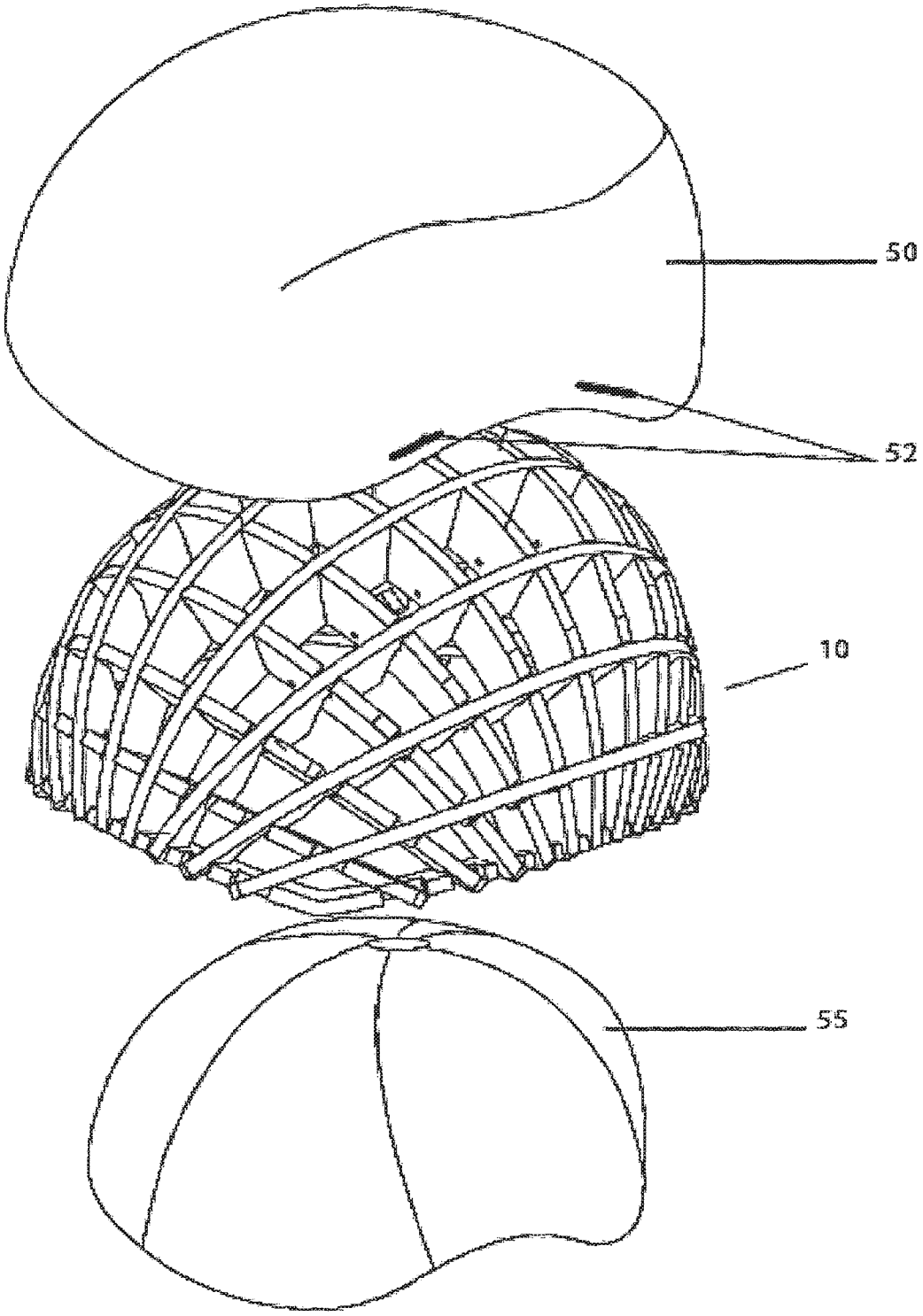
FIG. 6 is a schematic view of a helmet in accordance with the present invention using the shell shown in FIGS. 1 and 2.

The tubes 100 formed into an impact resistant shell may be incorporated into a helmet with an outer shell 50 and padding 55 (see FIG. 6).

The outside and inside surfaces of an impact resistant shell formed from an array of tubes 100 may be sanded to provide the hollow dome shape.

Figure 9A:
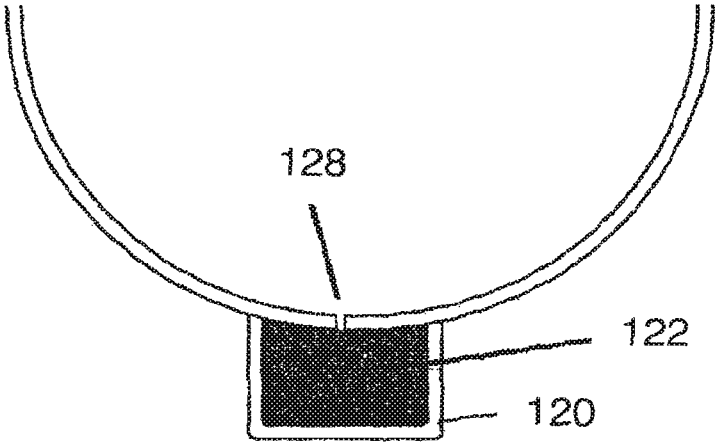
FIGS. 9*a* and 9*b* shows schematically a shock indicator for use as a helmet.
Figure 9B:
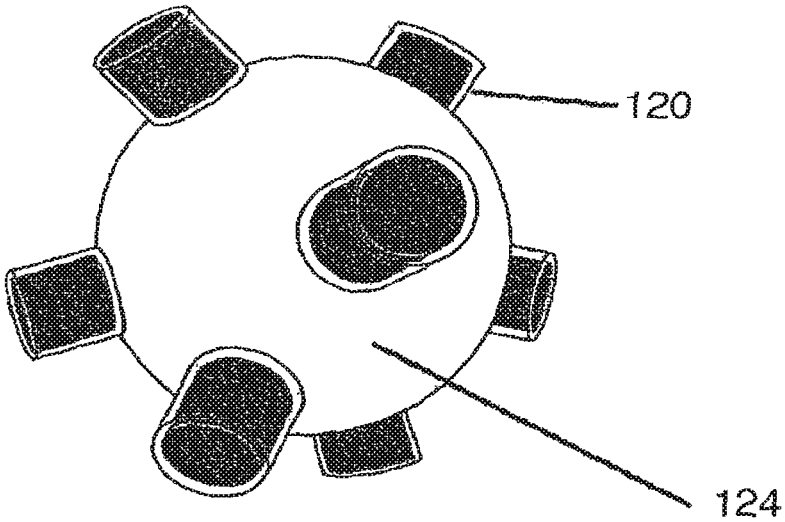

Turning finally to FIGS. 9*a* and 9*b*, an arrangement is shown that can detect when a helmet has been subject to impact forces (or shock) exceeding a threshold, indicating that the helmet should be replaced or at least the impact resistant shell 10 should be replaced. As shown in FIG. 9*a*, which shows the whole shock indicator; the indicator includes a central chamber 124 having a number of shock indicator flasks 120 spaced around it and preferably evenly spaced around it. FIG. 9*b*, is a schematic drawing showing one of the flasks 120 and part of the central chamber 124. Each flask includes a space 122 that is filled with coloured liquid that communicates with the central chamber 124 via a capillary bore 128. The common chamber 124 is initially empty. Because of the size of the capillary bore 128 and the viscosity of the liquid, the liquid is generally retained within the space 122. However, if a particular flask is subject to an acceleration or deceleration (in the case of the orientation shown in FIG. 9*a* in the vertical direction), the coloured liquid can be forced through the capillary bore into the previously empty common chamber 124. The presence of the coloured liquid within the chamber 124 indicates that the flask has been subject to excessive shock and that the helmet therefore needs replacing. The liquid may be such that it adheres to the walls in the common chamber 124 thereby clearly showing that one of the flasks 120 has been subject to an excessive shock. The indicator of FIGS. 9*a* and 9*b* can be incorporated into a holder that fits into a cavity within the helmet (not shown) and is held within that cavity by latches (again not shown). The indicator 120 can be small (of the order of a few centimeters) and so it can easily be accommodated in a relatively small cavity within a helmet. The common chamber 124 can be smaller than shown. A transparent or translucent lens (not shown) may be provided on the outside of the helmet to view the common indicator chamber 124; the magnification makes it easier to see whether or not liquid is located within the chamber 124.

The invention claimed is:

1. A head protection helmet comprising an impact resistant shell comprising:

a cavity for accommodating a user's head, the cavity having a front and a back; and an array of shock absorbing cells, each shock absorbing cell having four sides and an axis that extends outwardly from the cavity to permit the array of shock absorbing cells to absorb impact forces exerted along the direction of the axis;

wherein the array of shock absorbing cells is formed by a plurality of intersecting arc-shaped ribs overlying the cavity, wherein each rib of the plurality of ribs extends outwards from the cavity, and each rib includes an array of hollow cells, and wherein each hollow cell has a longest length that extends in a longitudinal direction of the hollow cell, the longitudinal direction being orthogonal to the arc defined by the hollow cell's respective arc-shaped rib.

2. A helmet as claimed in claim 1, wherein each rib of the plurality of ribs is formed of crushable sheet material including a plurality of sheets of crushable board, the plurality of sheets of crushable board including a first sheet extending outwards from the cavity and defining a plane of the rib and a second sheet extending outwards from the cavity, the second sheet being adjacent to the first sheet; and wherein each rib of the plurality of ribs also includes a first section connecting the first sheet to the second sheet;

wherein the first sheet, the second sheet and the first section form the array of hollow cells.

3. A helmet as claimed in claim 2, wherein the ribs each include multiple layers of the hollow cells, the plurality of sheets of crushable board of each rib including a third sheet extending outwards from the cavity, the third sheet being adjacent to the second sheet opposite from the first sheet, and each rib of the plurality of ribs includes a second section connecting the second sheet to the third sheet forming an array of crushable bodies.

4. A helmet as claimed in claim 2, wherein the hollow cells have an axis that lies orthogonal to the plane of the ribs.

5. A helmet as claimed in claim 2, wherein the plurality of ribs comprises a first set of ribs extending axially between the front and the back of the cavity a second set of and ribs extending laterally between two opposed sides of the cavity, the first set of ribs and the second set of ribs intersecting one another at crossed halved joints.

6. A helmet as claimed in claim 1, wherein each rib of the plurality of ribs is formed of crushable sheet material having at least one layer of the hollow cells.

* * * * *